US006325281B1

(12) United States Patent
Grogan

(10) Patent No.: US 6,325,281 B1
(45) Date of Patent: Dec. 4, 2001

(54) THERMALLY INSULATING SHIPPING SYSTEM

(75) Inventor: Kevin Grogan, Elmhurst, IL (US)

(73) Assignee: Polyfoam Packers Corporation, Wheeling, IL (US)

( * ) Notice: Subject to any disclaimer, the term of this patent is extended or adjusted under 35 U.S.C. 154(b) by 0 days.

(21) Appl. No.: 09/539,663

(22) Filed: Mar. 30, 2000

(51) Int. Cl.[7] ..... B65D 81/38

(52) U.S. Cl. ..... 229/103.11; 220/592.25; 229/122.34

(58) Field of Search ..... 229/103.11, 122.32, 229/122.33, 122.34; 220/561.1, 560.12, 560.15, 592.25, 592.26, 592.27; 62/60, 371, 372

(56) References Cited

U.S. PATENT DOCUMENTS

| | | | | |
|---|---|---|---|---|
| 1,527,167 | * | 2/1925 | Birdseye | 229/103.11 |
| 1,568,948 | | 1/1926 | Robe . | |
| 1,865,688 | * | 7/1932 | Hannaford | 229/103.11 |
| 1,890,771 | * | 12/1932 | Drummond | 62/60 |
| 1,930,680 | * | 10/1933 | Hinton | 229/103.11 |
| 2,523,145 | * | 9/1950 | Robinson | 229/103.11 |
| 2,807,402 | * | 9/1957 | Nelbach | 62/371 |
| 2,961,116 | | 11/1960 | Jeppson . | |
| 3,236,206 | * | 2/1966 | Willinger | 220/592.25 |
| 4,094,455 | * | 6/1978 | Bamburg et al. | 229/122.34 |
| 4,444,821 | | 4/1984 | Young et al. . | |
| 4,646,934 | | 3/1987 | McAllister . | |
| 4,778,078 | | 10/1988 | McAllister . | |
| 4,947,658 | * | 8/1990 | Wheeler et al. | 62/372 |
| 5,042,260 | * | 8/1991 | George, Sr. | 62/60 |
| 5,236,088 | | 8/1993 | Dhority et al. . | |
| 5,252,408 | | 10/1993 | Bridges et al. . | |
| 5,273,801 | | 12/1993 | Barry et al. . | |
| 5,314,087 | | 5/1994 | Shea . | |
| 5,316,171 | | 5/1994 | Danner, Jr. et al. . | |
| 5,441,170 | * | 8/1995 | Bane, III | 229/103.11 |
| 5,638,979 | | 6/1997 | Shea . | |
| 5,780,521 | | 7/1998 | Shmidt et al. . | |
| 5,897,017 | | 4/1999 | Lantz . | |
| 5,897,932 | | 4/1999 | McGarth et al. . | |
| 5,924,302 | | 7/1999 | Derifield . | |
| 5,979,693 | | 11/1999 | Bane, III . | |
| 6,055,825 | * | 5/2000 | Choy | 62/371 |

FOREIGN PATENT DOCUMENTS

| | | |
|---|---|---|
| 9859194 | 12/1998 | (WO) . |
| 9924327 | 5/1999 | (WO) . |
| 9932374 | 7/1999 | (WO) . |

OTHER PUBLICATIONS

Thermo Solutions Booklet, before Mar. 30, 1999.

ISC, Inc. VAC–Intact Brochure, before Mar. 30, 1999.

Dow Chemical Company Instill Booklet and Data Sheets for UC, HT and AF Products, before Mar. 30, 1999.

Thermo Solutions data Sheet, before Mar. 30, 1999.

Dow Chemical Company Instill Brochure, before Mar. 30, 1999.

* cited by examiner

*Primary Examiner*—Gary E. Elkins
(74) *Attorney, Agent, or Firm*—Seyfarth Shaw

(57) ABSTRACT

An insulating shipping container includes an outer cardboard carton with a foldable top; an open-top, rigid, first thermally insulating housing formed of expanded polystyrene and removably disposed in the outer carton; a second open-top, thermally insulating housing formed of vacuum insulating panels and removably disposed in the first housing; an inner cardboard carton with a foldable top removably disposed in the second housing; and a closure structure including a vacuum insulating panel and expanded polystyrene panels for closing the open tops of the second and first housings.

20 Claims, 3 Drawing Sheets

THERMALLY INSULATING SHIPPING SYSTEM

BACKGROUND OF THE INVENTION

The invention relates to thermally-insulated packaging and, more particularly, to packaging of the type which may be used for shipping of materials, such as perishable materials, which must be maintained within a certain temperature range.

The shipping or transportation of various perishable materials frequently requires that such materials be maintained in a stable temperature range, either higher or lower than ambient temperatures to which the packaging of the materials will be exposed. Thus, there have heretofore been provided a number of different types of thermally insulated containers. A reusable pallet shipper is sold by ISC, Inc. under the trademark "VAC-INTACT." The insulation is provided by vacuum insulation panels, each of which includes a vacuum core formed of open-cell polystyrene, and sandwiched between a rigid polyurethane sheet and a protective hard plastic sheet, the foregoing sandwich in turn being sandwiched between a pair of corrugated outer layers, the components all being adhered together. While this arrangement provides very good thermal insulation, it has the disadvantage that, in the event that the vacuum core should be damaged, destroying the vacuum therein, the entire panel assembly must be replaced, since it is of an integral construction.

Thermal Solutions, Inc. sells an insulated container of molded construction, which includes vacuum insulation panels molded in place in the container walls to better protect them from damage. This also provides an effective thermal insulation, but is very expensive.

SUMMARY OF THE INVENTION

It is a general object of the invention to provide an improved thermally insulating container which avoids the disadvantages of prior insulated containers, while affording additional structural and operating advantages.

An important feature of the invention is the provision of a thermally insulating container which is of relatively simple and economical construction.

Another feature of the invention is the provision of a container of the type set forth which is formed of separable layers, so that if one of the layers is damaged only that layer need be replaced.

Certain ones of these and other features of the invention may be attained by providing a thermally insulating container comprising: an outer closable carton, a first insulating housing removably disposed within the outer carton and formed of a first thermally insulating material, a second insulating housing removably disposed within the first housing and formed of a second thermally insulating material, and an inner closable carton removably disposed within the second housing.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
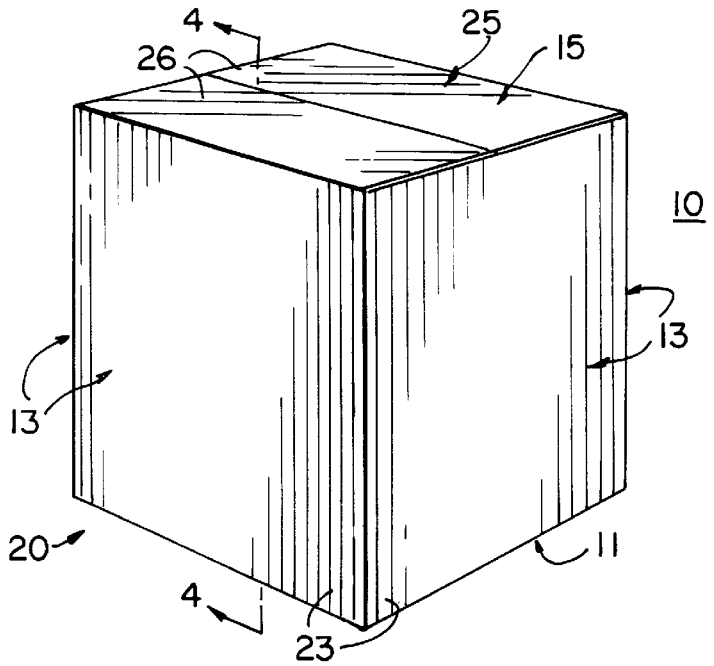
FIG. 1 is a perspective view of a container in accordance with the present invention in its closed condition.

Referring to FIGS. 1–4, there is illustrated a thermally insulating container, generally designated by the numeral 10, in accordance with the present invention. The container 10 has a box-like configuration including a rectangular bottom wall 11 (see FIGS. 1 and 4), four upstanding side walls 13 and a top wall 15. While, for purposes of illustration, the container 10 is illustrated as having the shape of a rectangular parallelepiped, it will be appreciated that it could have other shapes. It is a significant aspect of the invention, that the container 10 is made up of a plurality of discrete, removably nested units, including an outer carton 20, a first insulating housing 30, a second insulating housing 40, an inner carton 50 and a closure lid 60.

Figure 3:
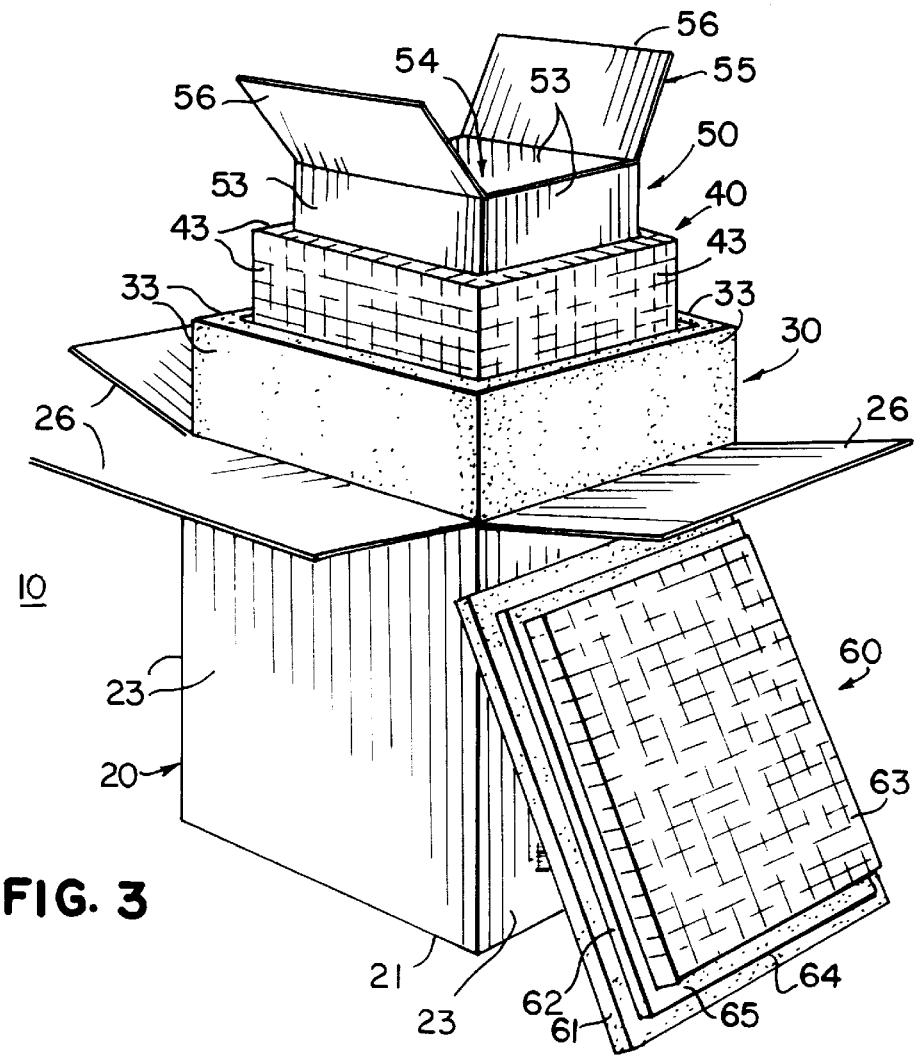
FIG. 3 is a perspective, partially exploded view of the container of FIG. 1.
Figure 2:
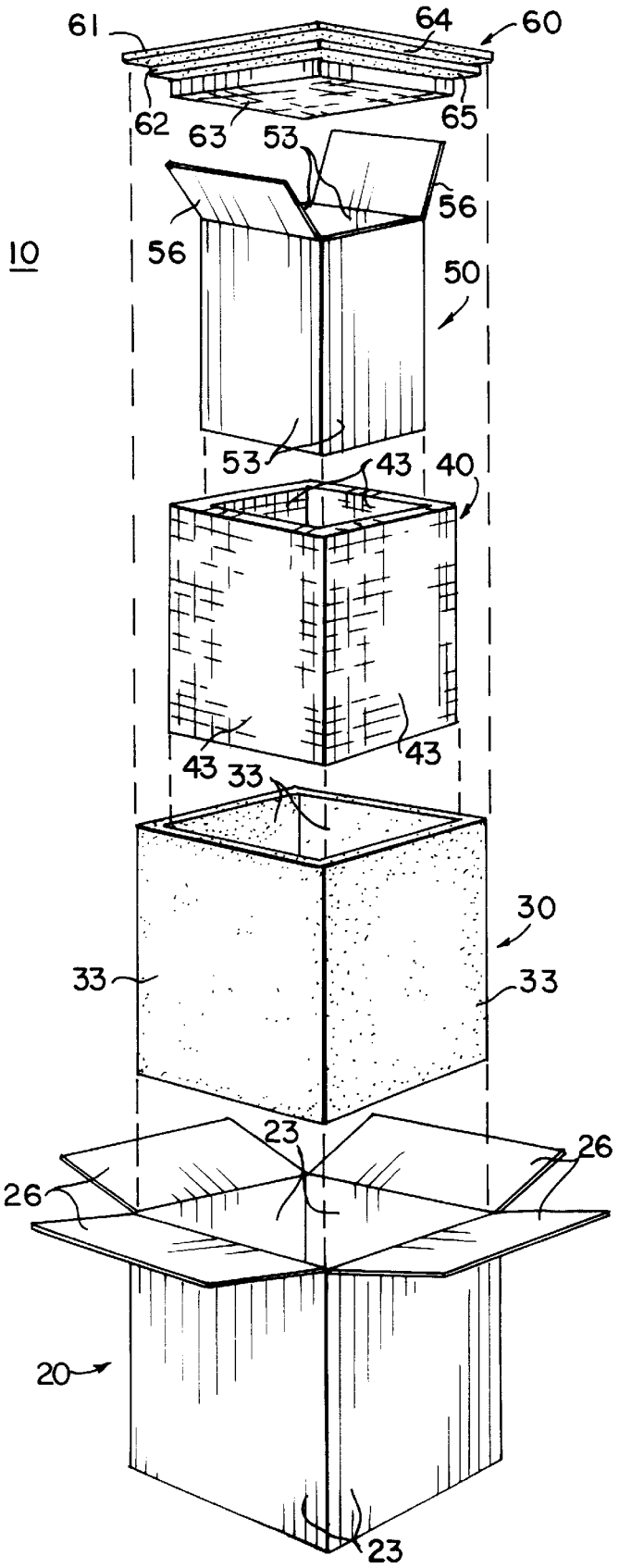
FIG. 2 is a slightly reduced, exploded, perspective view of the container of FIG. 1.

Referring in particular to FIGS. 2 and 3, the outer carton 20 is preferably formed of a corrugated cardboard material or the like, and includes a bottom panel 21 (FIG. 4), which may include foldable flaps 22, four upstanding rectangular side panels 23, and a top panel 25, which may be made up of foldable flaps 26.

The insulating housing 30 is of rigid construction, preferably being formed of expanded polystyrene, although other thermally insulating materials could be used. The insulating housing 30 is of open-top construction, including a rectangular bottom panel 31 (FIG. 4) and four upstanding rectangular side panels 33, and is dimensioned to fit snugly within the outer carton 20, as illustrated in FIG. 3.

Figure 4:
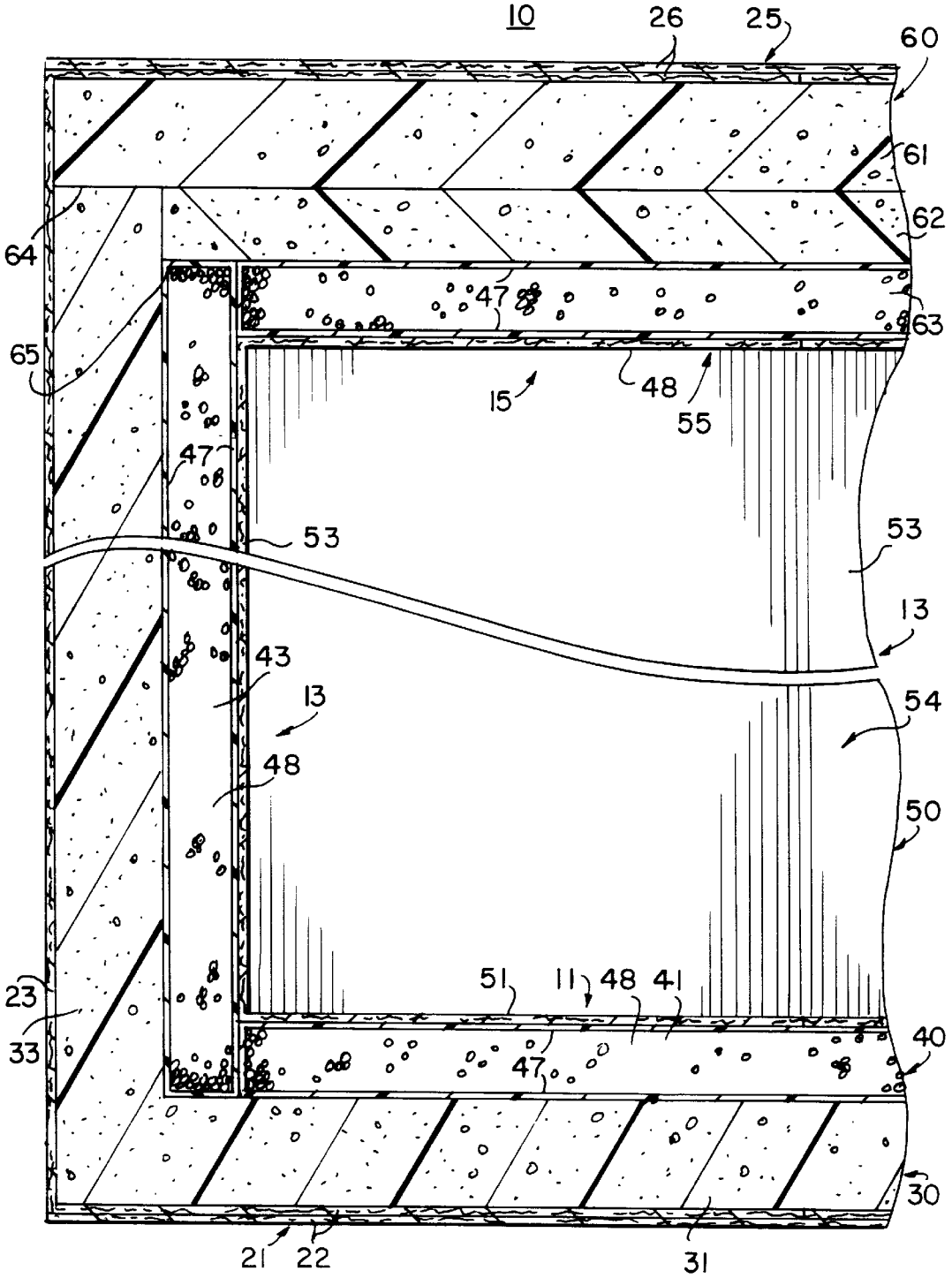
FIG. 4 is an enlarged, fragmentary view in vertical section taken generally along the line 4—4 in FIG. 1.

The insulating housing 40 is preferably made up of vacuum insulation panels. More particularly, the insulating housing 40 is also of open-top construction, and includes a rectangular bottom panel 41 (FIG. 4) and four upstanding, rectangular side panels 43. Each of the panels 41 and 43 includes an outer barrier film 47 surrounding an insulating core 48 and maintaining a vacuum within the core 48 in a known manner, as best illustrated in FIG. 4. The vacuum insulation panels may be of any of a number of different types of commercially available panels, such as panels wherein the core 48 is formed of a relatively rigid material, such as open-cell polystyrene, and types wherein the core 48 is in the nature of a particulate silicon material. The barrier film 47 is formed of a suitable gas-impervious material, such as a suitable foil, and sustains the required vacuum within the panel for the desired life of the panel. The core 48 may include desiccants to protect the vacuum from intrusion by water molecules.

The inner carton 50 is also preferably formed of a corrugated cardboard material or the like, and is dimensioned to be snugly received within the insulating housing 40, as is best illustrated in FIG. 3. More specifically, the inner carton 50 includes a rectangular bottom panel 51 (FIG. 4), which may include one or more foldable flaps, and four rectangular upstanding side panels 53. The inner carton 50 is dimensioned to fit snugly within the insulating housing 40 (see FIG. 3) and defines therein a storage compartment 54. The inner carton 50 is also provided with a top panel 55, which may include a plurality of foldable flaps 56.

The container 10 also includes a rectangular closure lid 60 for closing the open tops of the insulating housings 30 and 40. More specifically, the closure lid 60 includes an outer rectangular expanded polystyrene panel 61, having secured to one surface thereof a smaller rectangular expanded polystyrene panel 62. A vacuum insulation panel 63, of the same type as the panels of the insulating housing 40, is secured to the inner surface of the panel 62. The panels 61–63 are all centered with respect to one another and are of decreasing size, so that the panels 61 and 62 cooperate to define a peripheral shoulder 64 having a depth equal to the thickness of each of the side panels 33 of the insulating housing 30. Similarly, the panels 62 and 63 cooperate to define a peripheral shoulder 65 having a width equal to the thickness of the side panels 43 of the insulating housing 40.

Referring to FIG. 4, the side panels 33 of the insulating housing 30 are shorter than the side panels 23 of the outer carton 20 and longer than the side panels 43 of the insulating housing 40. Thus, the upper ends of the side panels 33 are spaced from the upper ends of the side panels 23 by a distance substantially equal to the thickness of the closure lid panel 61, and spaced above the upper ends of the side panels 43 by a distance substantially equal to the thickness of the closure lid panel 62. Thus, the closure lid 60 can be fitted on top of the nested units, with the closure lid panel 63 fitting snugly within the open top of the insulating housing 40, with the closure lid panel 62 fitting snugly within the open top of the insulating housing 30 and resting upon the upper ends of the side panels 43, and with the closure lid panel 61 nesting snugly within the side walls 23 of the outer carton 20 and supported upon the upper ends of the side panels 33.

In the illustrated embodiment, the outer carton 20 has four top panel flaps 56 and the inner carton 50 has two top panel flaps 56. However, it will be appreciated that each of the top panels 25 and 55 could have either two flaps or four flaps and, likewise, each of the bottom panels 21 and 51 could have either two flaps or four flaps.

In assembly, the outer carton 20 is formed with its top panel 25 open, and then the insulating housing 30 is nested in the carton 20, the insulating housing 40 is nested in the housing 30, and the inner carton 50 is nested in the housing 40, as illustrated in FIGS. 2 and 3. The material to be shipped is then disposed in the storage compartment 54 of the inner carton 50 and its top wall 55 is closed. Then the closure lid 60 is fitted in place and the top panel 25 of the outer carton 20 is closed. Suitable taping, strapping or the like may be applied, as desired, depending upon the application.

It can be seen that the fragile vacuum insulation panels of the insulating housing 40 are fully protected, on the inside by the inner carton 50, on the outside by the rigid insulating housing 30, and at the top edges by the closure lid 60. However, in the event that one or more of the vacuum insulation panels of the insulating housing 40 should become damaged so as to destroy the vacuum thereof, only the insulating housing 40 need be replaced, without having to replace any of the other units of the container 10. There results a container which provides effective thermal insulation while being relatively economical.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A thermally insulating container comprising:

an outer closable carton, a first substantially rigid insulating housing removably disposed within said outer carton and formed of a first thermally insulating material different from the material of the outer carton, a second substantially rigid insulating housing removably disposed within said first housing and formed of a second thermally insulating material different from the first thermally insulating material and from the material of the outer carton, and an inner closable carton removably disposed within said second housing.

2. The container of claim 1, wherein each of said inner and outer cartons is formed of corrugated cardboard.

3. The container of claim 1, wherein said first thermally insulating material is expanded polystyrene.

4. The container of claim 1, wherein said second housing is formed of vacuum insulation panels.

5. The container of claim 1, wherein each of said vacuum insulation panels includes a core and a barrier film surrounding the core for preserving a vacuum therein.

6. The container of claim 5, wherein said core includes a granular insulating material.

7. The container of claim 1, wherein each of said inner and outer cartons includes a foldable top.

8. The container of claim 1, and further comprising closure structure for closing the tops of said first and second housings.

9. The container of claim 8, wherein said closure structure is of integral construction.

10. A thermally insulating container comprising:

an outer closable carton, a first open-top insulating housing removably disposed within said carton and formed of a first thermally insulating material, a second open-top insulating housing removably disposed within said first housing and formed of a second insulating material, an inner closable carton removably disposed within said second housing, and closure structure for closing the tops of said first and second housings, said closure structure including a support panel dimensioned to overlie said first housing at the open top thereof for support thereon, a first closure panel secured to said support panel and dimensioned to be received in the open top of said first housing for housing for closing same, and a second closure panel secured to said first closure panel and dimensioned to be received in the open top of said second housing for closing same.

11. The container of claim 10, wherein said support panel and said first closure panel are formed of expanded polystyrene and said second closure panel is a vacuum insulation panel.

12. The container of claim 11, wherein said vacuum insulation panels are rigid.

13. The container of claim 11, wherein each of said vacuum insulation panels includes a granular insulating material.

14. The container of claim 10, wherein each of said inner and outer cartons is formed of corrugated cardboard.

15. The container of claim 14, wherein each of said inner and outer cartons includes a foldable top.

16. A thermally insulating container comprising:

an outer closable carton a first substantially rigid insulating housing removably disposed within the outer carton and formed of expanded polystyrene, a second insulating housing removably disposed within the first housing and formed of vacuum insulation panels, and an inner closable carton removably disposed within the second housing.

17. The container of claim 16, wherein each of the inner and outer cartons is formed of corrugated cardboard.

18. The container of claim 16, wherein the vacuum insulation panels are rigid.

19. The container of claim 16, wherein each of the inner and outer cartons includes a foldable top.

20. The container of claim 16, and further comprising closure structure for closing the tops of the first and second housings.

* * * * *